US005446702A

United States Patent [19]

Mossuz et al.

[11] Patent Number: 5,446,702

[45] Date of Patent: Aug. 29, 1995

[54] HOROLOGICAL PIECE COMPRISING A BATTERY END OF LIFE INDICATOR DEVICE

[75] Inventors: Gabriel Mossuz, Annemasse; Pascal Puthod, Arenthon, both of France

[73] Assignee: ISA France S.A., Villers-le-Lac, France

[21] Appl. No.: 229,346

[22] Filed: Apr. 18, 1994

[30] Foreign Application Priority Data

Apr. 20, 1993 [CH] Switzerland ..... 01199/93

[51] Int. Cl.[6] ..... G04B 19/20; G04B 9/00

[52] U.S. Cl. ..... 368/37; 368/66

[58] Field of Search ..... 368/28, 34–38, 368/64, 66, 20–204

[56] References Cited

U.S. PATENT DOCUMENTS

| | | | |
|---|---|---|---|
| 3,928,846 | 12/1975 | Arai et al. | 340/325 |
| 3,998,043 | 12/1976 | Tamaru et al. | 58/23 R |
| 4,266,288 | 8/1981 | Berney | 368/28 |
| 4,290,129 | 9/1981 | Ushikoshi | 368/66 |
| 4,493,559 | 4/1985 | Ishida et al. | 368/74 |
| 5,187,693 | 12/1993 | Besson | 368/35 |
| 5,289,437 | 12/1994 | Legenberger | 368/37 |

OTHER PUBLICATIONS

Patent Abstracts of Japan vol. 8, No. 42 (P-256) 23 Feb. 1984 & JP-A-58 195 177 (Seikoushiya K.K.).

*Primary Examiner*—Vit W. Miska

*Attorney, Agent, or Firm*—Griffin, Butler, Whisenhunt & Kurtossy

[57] ABSTRACT

A horological piece includes a display (10) comprising a recurring cycle indicator (13) driven by an independent motor (11) and having a supplementary display position (14) at which a sign representative of the state of charge of an energy source controlling the display, is provided. The horological piece further includes a detection circuit (2, 16) adapted to, firstly, during the detection of a predetermined level of charge of the energy source, control the display so that the recurring cycle indicator is moved the required number of steps to display the representative sign and, secondly, jump the supplementary position during the normal operation of the horological piece.

8 Claims, 2 Drawing Sheets

HOROLOGICAL PIECE COMPRISING A BATTERY END OF LIFE INDICATOR DEVICE

The present invention concerns horological pieces provided with an exhaustable energy supply such as a battery.

More particularly, the invention relates to such a horological piece in which provision is made for means to indicate the transition of the level of charge of the energy source above a predetermined level judged to be that above which this source must either be recharged or replaced. These means are commonly known by the expression "battery end of life indicator".

In the present description, the term "horological piece" should be understood in its moss general sense, watches, alarm-clocks and other analogies pieces being particularly kept mind.

Currently several types of battery end of life indicators are known. For example, certain types of watches use one of the hands, preferably the second-hand, to indicate the end of life of the battery, the hand being caused to execute a particular movement when the electronic circuit of the watch detect an insufficient battery charge, A typical case is, in this respect, a watch in which, in this situation, the second-hand makes a movement of two steps once every two seconded.

Other device of this type cause the appearance, behind a special window of the dial of the horological piece, of a sign indicating the insufficient state of charge, formed for example by a particular colour or representing a pictogramme of the battery.

Another battery end of life indicator device, described in the Japanese utility model application JP 56/6958, uses the time-keeping marks of the dial formed by as many windows therein, to cause the appearance of a sign representative of the insufficient state of charge of the battery. More precisely, in this document, a ring indicator is able to move under the time-keeping marks of the dial and can be driven at the appropriate moment by the day of the month ring of the watch, due to a coupling which is operated at that instant and which is interposed between the two rings. It is clear that this device concerns a watch of a particular type whose esthetic is limited by the nature of the time-keeping marks in the form of windows. Further, this device requires space not only in height because of the coupling but also in a plane perpendicular to the axis of the hands, due to the fact that the indicator ring of the battery end of life is located at the exterior of the day of the month ring. This prior device thus presents certain inconveniences.

Another battery end of life indicator device is known from the Japanese patent application JP 57 233/87. This concerns a horological piece in the form of an alarm comprising a day of the month indicator which appears in a window formed in the dial of the piece. Behind this window is also placed a flap which, in the case of an insufficient battery charge, masks the day of the month indicator and places a sign in the window warning the user that the battery must be changed.

This prior device thus makes use, in a certain manner, "by default" of the day of the month indicator as it includes an organ (the flap) which masks this indicator at the appropriate movement. However, this device is also cumbersome and does not lend itself easily to use in an alarm-clock or in a table-clock.

An aim of the invention is to overcome the disadvantages of the prior art and to propose a horological piece having a battery end of life indicator device which is not or is less cumbersome that the prior art and is easy to adapt to the usual construction of horological movement.

The invention thus provides an electronic horological piece comprising:

a time-keeping circuit;

first display means controlled by said time-keeping circuit to display the time;

second display means of an analog type also controlled by said time-keeping circuit for displaying at least a recurring cycle of time varying units;

an energy source connected so as to provide power to said time-keeping circuit and said first and second display means; and a control and detection circuit connected to said energy source and to said second display means for, as a function of the state of charge of said source being less than a predetermined level, controlling said second display means so that they adopt a configuration in which said charge state is indicated, this horological piece being characterized in that:

said second display means comprise at least a recurring cycle indicator driven by an independant motor and having a supplementary display position at which a sign representative of said state of charge is intended; and said control and detection circuit being adapted to, firstly, during the detection of said predetermined charge level, control said second display means so that they move said recurring cycle indicator by the number of steps required to display said representative sign and, secondly, jump said supplementary position during the normal operation of said horological piece.

As a result of these characteristics, the end of life of the battery of the horological piece can be indicated by an indicator, such as the day of the month indicator or the days of the week indicator, which is already present in the horological piece, and to which it suffices to add a supplementary display position at which a pictogramme for example may be intended, representing the exhaustion of the battery. This battery end of life indication device according to the invention, thus necessites no supplementary mechanical organ to fulfill this particular function.

As a consequence, the indicator device according to the invention is easily adaptable to existing horological movements in as much as they have already an independently driven day of the week indicator and where a programmed control circuit is consequently incorporated.

It is convenient to fix the level of charge at which the control and detection circuit reacts in order to cause the indicator to adopt its supplementary position, to a value such that the energy source still possesses a sufficient quantity of energy to be able to transmit the required number of steps to the indicator. Further, this quantity of energy is advantageously increased in such a way that the horological piece can still operate to indicate the time during a predetermined period giving its user sufficient time to change the battery.

It is thus advantageous to supply the second display means with a bidirectional motor and to conceive the control and detection circuit in such a way that it is able to cause the indicator to travel the shortest path towards the supplementary position, from the instantaneous position of the indicator at the moment of the detection of said predetermined level.

Other characteristics and advantages of the invention will appear during the description which will now follow, given solely as an example and made in reference to the attached drawings in which:

FIG. 1 shows a graph of the voltage U of a battery, well known in horologery, as a function of time t, the scale of the abscissa being greatly expanded at the end of life of the battery.

The battery has a maximum voltage at full charge $U_1$. During the use of the battery, this voltage progressively diminishes to attain at a time $t_1$ a value $U_2$ at which it is estimated necessary to commence the operations indicating the end of life the battery. A third voltage value $U_3$ reach at time $t_2$ corresponds to the exhaustion of the battery at the point where it is no long capable of supplying energy to the circuit of the horological piece.

Solely as an example of a-practical case, the voltages $U_1$, $U_2$ and $U_3$ are respectively 3.1 volts, 2.7 volts and 2.5 volts, the period $t_2$-$t_1$ being able to be equal to two weeks of operation of the horological piece. The period of time until the instant $t_1$ naturally depends on several factors, such as the consommation of the horological piece or the capacity of the battery. It should also be noted that the voltage $U_2$ should be chosen so that the battery still has sufficient energy to be able to drive the day of the week indicator towards its position indicating the end of life of the battery, as will be seen from the following.

Figure 1:
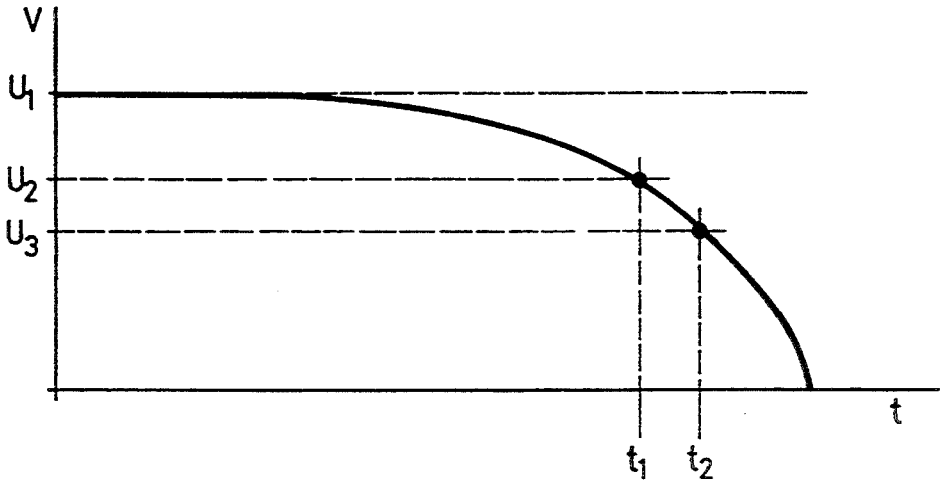
FIG. 1 is an example of a decharging curve of a battery used in an horological piece, on which are drawn varies voltage levels important for the, understanding of the invention.
Figure 2:
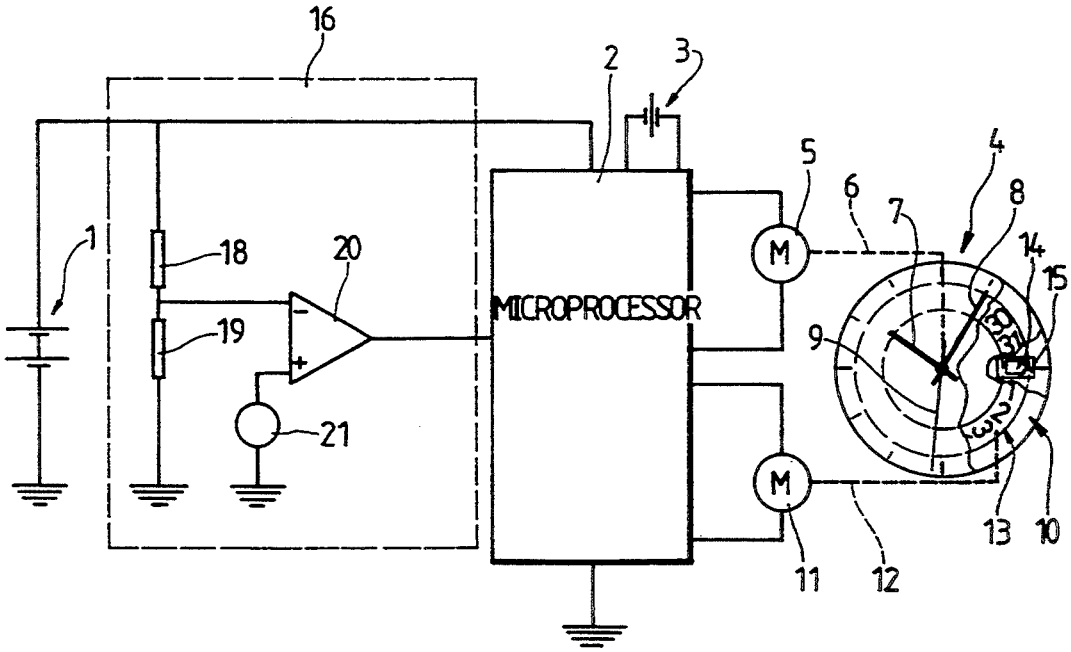
FIG. 2 is a simplified schematic of a horological piece and its electronic circuit according to the invention.

FIG. 2 represents a simplified schematic of a horological piece according to the invention, which comprises a battery 1 whose decharging curve is approximately equal to that shown in FIG. 1.

This horological piece also includes a microprocessor 2 programmed in a known manner so as to assure, firstly, the time-keeping operation which is governed by a quartz 3. The microprocessor develops control pulses, for example at a rate of one per second, to excite first display means 4 of an analog type formed hence by a step motor 5 driving, by a gear wheel symbolized by a broken line 6, the hourhand 7, the minute-hand 8 and the second-hand 9 of the horological piece. It should be noted that the first display means may be of a numeric type. An example of a commercial microprocessor adapted to fulfill the function of that represented in the FIG. 2 is a four-bit microprocessor chosen from the familly "MARC 4" made by the company "Eurosil".

The horological piece according to the invention further comprises second display means 10, of analog type, which includes a step motor 11 receiving its control pulses from the microprocessor 2 at the appropriate instants, that is to say on every occurrence of the passing of midnight from one day to the next.

In the represented example, it is presumed that the motor 11 is mechanically coupled, by a gear wheel or a direct coupling 12, to a day of a month-ring 13 bearing the numbers of the days of the month (1 to 31), as well as at a supplementary position, a sign 14 of the battery end of life. As it is well known in horologery, the inscriptions on the ring 13 may appear, according to a recurring cycle, being a window 15 in the dial of the horological piece. It this case, the recurring cycle is thus formed by the day of the month. Nevertheless, it is possible to use, in the same aim of indicating the end of life of the battery 1, another indicator of time varying units, such as that of the days of the week, or the months of the year for example, in consideration of which the sign 14 must be provided for on the corresponding indicator organ sometimes called a days of the week disk or "day-star". This must then be driven in independent manner, as is the case with the day of the month-ring 13 in the above described example.

Another variant of the invention consists of the use of a hand as an indicator of time varying units, this hand having a supplementary position to display the battery end of life.

Of course, the variant implying the indicator of the days of the week to indicate the battery end of life is less favorable from the point of view of the energy consumption than the solution of FIG. 2, but may nevertherless lead to beneficial effect.

The horological piece according to the invention further comprises a control and detection circuit partially realized by the microprocessor 2 and further by an comparator 16 which appears to the left on FIG. 2 and which is intended to compare the voltage of the battery to a reference voltage $U_2$ and to create a binary signal of the battery end of life being able to be interpreted by the microprocessor 2.

The battery 1 is connected to a voltage devider formed by two resistances 18 and 19. The junction of the resistances 18 and 19 is connected to the inverting input of a voltage comparator 20. The non inverting input of this comparator is connected to a reference voltage source 21 equal to $U_2 \times R19/R19+R18$, $U_2$ being the voltage of FIG. 1.

Figure 3:
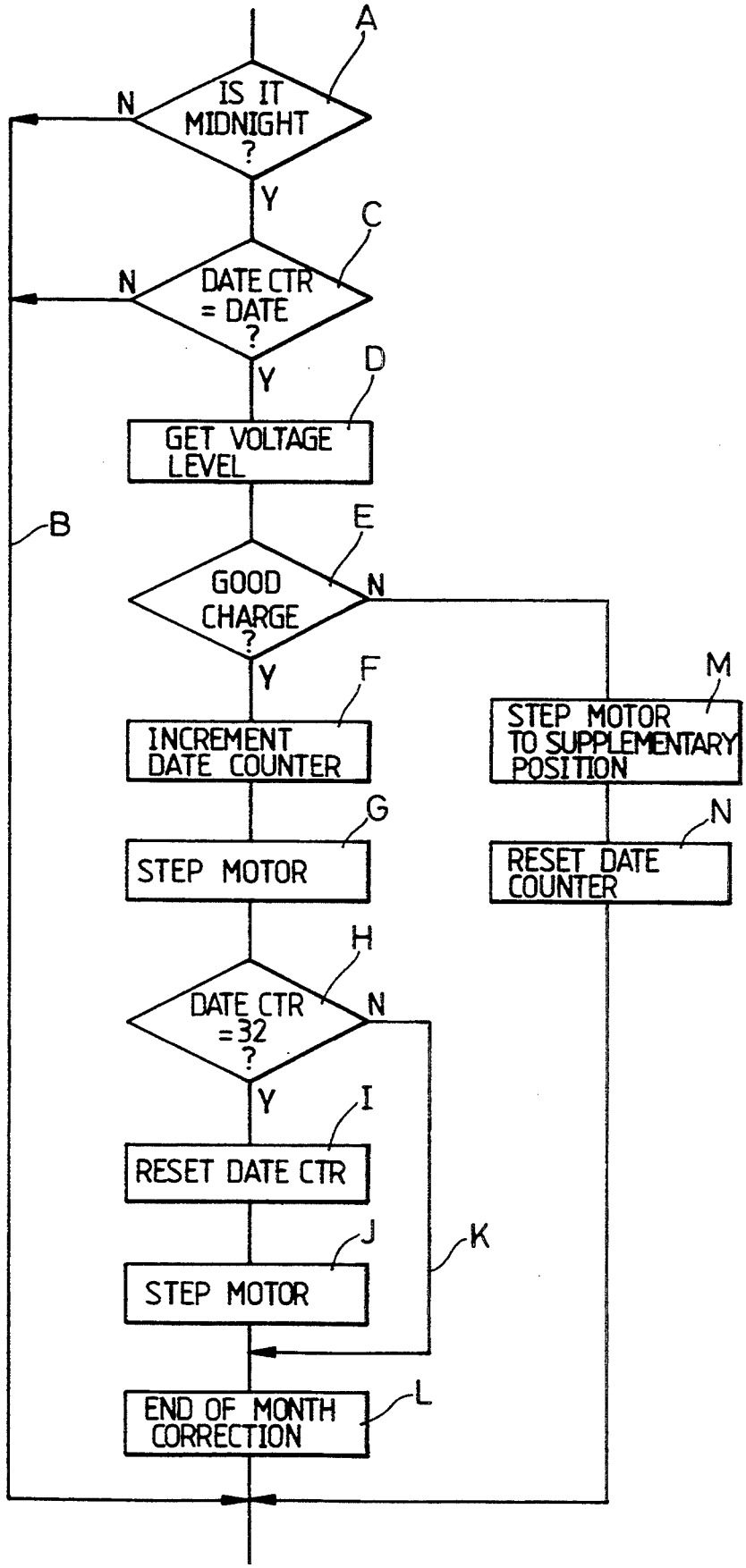
FIG. 3 is an organigramme of the programming of the circuit of FIG. 2.

The output of the comparator 20 is connected to an input of the microprocessor 2. When the battery voltage becomes less than $U_2$, the voltage at the junction between the resistances 18 and 19 becomes less than the reference voltage 21, the logical level at the output of the comparator changes state, FIG. 3 represents an organigramme of a part of the program realized in the microprocessor 2 so that it can assure the progression of the days of the month-ring during the normal operation of the horological piece (battery with a sufficient charge level) or to indicate the battery end of life.

A test is performed at A to assure that the hour counter, minute counter and secondes counter of the time-keeping circuit realized in a microprocessor 2 are zero. Whilst this condition is not fulfilled, the program jumps by B to be able to accomplish the normal time-keeping functions of the first display means 4.

If the test at A proves to be affirmative (that is to say, at midnight), the program passes to another test at C where is it stated if the date counter realized in the microprocessor is at one of the positions indicating a date. If the test results in the negative (that is to say the disc indicates the pictogramme of the battery end of life), the program jumps B as was the case previously.

If, in the other hand, the test is affirmative, the microprocessor 2 reads the logical level at the output of the voltage comparator 20.

This level is tested at E. If it corresponds to that indicating a good level of charge of the battery 1

($U > U_2$), the program passes to an operation at F during which the date counter is advanced by one unit. Then, by another operation at G the microprocessor 2 sends a pulse to the motor 11 so that it advances the day of the month-ring 13 by one step.

Then a test is effectuated at H to assure that the day of the month-ring 13 or the date counter are in the position 32, that is to say in the supplementary position. In the affirmative, the date counter is reset to 01 at I, and at J the motor 11 is con,rolled so that it advances the day of the month indicator 13 by a supplementary step.

If the test at M is negative, the program jumps at K to ignore the two preceding operations.

The microprocessor may further by the operation L effectuate the corrections necessary at the end of the month (month of 28, 29 and 30 days).

If the test at E happens to be negative, the microprocessor 2 controls the motor 11 at M in such a way as to place the day of the month counter 13 in its supplementary position of indicating the battery end off life, in which the corresponding pictogramme appears behind the window 15, Another operation N places the date counter at zero and the program passes to the ordinary time-keeping functions.

If the indicator is a "day-star" or an indicator of the month of the year, the steps occur "mutatis muntandis" in a cycle respectively of seven or twelve steps, not including the supplementary position.

It should be further noted-that the invention provides a horological piece allowing the indication of the battery end of life resulting from minimum modifications to bring to classical horological movements due to the utilisation of a usual indicator of time varying units.

We claim:

1. Electronic horological movement for use in a wristwatch or table clock comprising:

a time-keeping circuit;

a first motor;

first display means controlled by said time-keeping circuit for displaying the time and driven by said first motor;

second display means controlled by said time-keeping circuit for displaying the day of the week or the day of month, said second display means constituted of day of the week or a day of the month ring;

an energy source connected so as to provide power to said time-keeping circuit and said first and second display means; and a control and detection circuit connected to said energy source and to said second display means for, as a function of a state of charge of said source being less than a predetermined level controlling said second display means so that said second display means adopt a configuration in which said state of charge is indicated, said day of the week or day of the month ring comprising at least a recurring cycle indicator driven by a second motor independent from first motor and said day of the week or day of the month ring having a supplementary display position at which is provided a sign representative of said state of charge; and said control and detection circuit being adapted to, firstly, during the detection of said predetermined charge level, control said second display means so that they move the day of the week or day of the month ring a required number of steps to indicate said representative sign, and, secondly, jump said supplementary position during the normal operation of said horological movement.

2. Electronic horological movement according to claim 1, wherein said predetermined level is fixed at a value such that, when it is reached said source is at least capable of bringing said day of the week or day of the month ring to said supplementary display position.

3. Electronic horological movement according to claim 2, wherein said predetermined level is fixed at a value such that when it is reached, said source is further capable of providing energy to the horological movement during a predetermined period of time.

4. Electronic horological movement according to claim 3, wherein said second motor is bidirectional and said control and detection circuit is arranged so that, when said predetermined level is attained, it brings said indicator to said supplementary position by the shortest path.

5. Electronic horological movement according to claim 1, wherein said predetermined level is fixed at a value such that when said predetermined level is reached said source is further capable of providing energy to the horological movement during a predetermined period of time.

6. Electronic horological movement according to claim 1, wherein said second motor is bidirectional and wherein said control and detection circuit is arranged so that, when said predetermined level is attained, it brings said indicator to said supplementary position by the shortest path.

7. Electronic horological movement according to claim 2, wherein said motor is bidirectional and said control and detection circuit is arranged so that, when said predetermined level is attained, it brings said indicator to said supplementary position by the shortest path.

8. Electronic horological movement for use in a wristwatch or table clock comprising:

a time-keeping circuit;

a first motor;

first display means controlled by said time-keeping circuit for displaying the time, said first display means being driven by said first motor;

second display means controlled by said time-keeping circuit for displaying the day of the week or the day of month, said second display means comprising a day ring selected from a group of day rings consisting of a day of the week ring and a day of the month ring;

an energy source for providing power to said time-keeping circuit and said first and second display means; and a control and detection circuit connected to said energy source and to said second display means for controlling said second display means to indicate a state of charge of said energy source when said state of charge is less than a predetermined charge level, said day ring being driven by a second motor independent from said first motor, and said day ring having a supplementary display position at which is provided a sign representative of said state of charge; and said control and detection circuit being adapted to, firstly, during the detection of said predetermined charge level, control said second display means to move the day ring a required number of steps to indicate said representative sign, and, secondly, jump said supplementary position during the normal operation of said horological movement.

* * * * *